US007699110B2

(12) United States Patent
Anderson et al.

(10) Patent No.: US 7,699,110 B2
(45) Date of Patent: Apr. 20, 2010

(54) FLOW DIVERTER TOOL ASSEMBLY AND METHODS OF USING SAME

(75) Inventors: Neil Anderson, Insch (GB); David Duncan, Insch (GB); Roy E. Swanson, Sugar Land, TX (US); John Pickett, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 625 days.

(21) Appl. No.: 11/489,413

(22) Filed: Jul. 19, 2006

(65) Prior Publication Data

US 2008/0017384 A1 Jan. 24, 2008

(51) Int. Cl.
*E21B 37/00* (2006.01)

(52) U.S. Cl. ..... 166/368; 166/339; 166/344; 166/348; 166/311; 166/312; 166/222

(58) Field of Classification Search ..... 166/368, 166/339, 344, 348, 99, 311, 312, 347, 88.4, 166/269, 222, 223
See application file for complete search history.

(56) References Cited

U.S. PATENT DOCUMENTS 4,046,191 A * 9/1977 Neath ..... 166/352
4,799,554 A * 1/1989 Clapp et al. ..... 166/312
5,722,489 A * 3/1998 Lambe et al. ..... 166/269
6,050,339 A * 4/2000 Milberger ..... 166/368
6,401,813 B1 * 6/2002 Carmichael et al. ..... 166/173
6,408,947 B1 * 6/2002 Cunningham et al. ..... 166/339
6,453,996 B1 * 9/2002 Carmichael et al. ..... 166/177.3
6,607,031 B2 * 8/2003 Lynde et al. ..... 166/99
6,655,455 B2 * 12/2003 Bartlett et al. ..... 166/86.2
6,659,181 B2 * 12/2003 Hartmann ..... 166/348

(Continued)

FOREIGN PATENT DOCUMENTS

WO WO 03/069112 A 8/2003

(Continued)

OTHER PUBLICATIONS

Baker Hughes Incorporated, Clean Bore Riser Brush and Boot Basket, Product Family No. H13014, Sep. 24, 2003, pp. 1-6, Houston, USA.

(Continued)

*Primary Examiner*—Thomas A Beach
*Assistant Examiner*—Matthew R Buck
(74) *Attorney, Agent, or Firm*—Greenberg Traurig LLP; Anthony F. Matheny

(57) ABSTRACT

A flow diverter tool assembly is employed for flushing debris from a portion of the bore of a subsea production tree. The flow diverter tool assembly has a housing having a passageway there-through and a seal disposed on an exterior surface of the housing. The seal contacts the inner wall surface of the bore of the production tree, dividing a lower portion of the bore below the seal from an upper portion of the bore above the seal. One or more outlets from the passageway through the exterior surface are disposed along the housing below the seal. A bypass device such as a slip-joint is disposed above the seal to facilitate removal of the flow diverter tool assembly from the bore of the production tree after its use.

20 Claims, 5 Drawing Sheets

U.S. PATENT DOCUMENTS

| | | | | |
|---|---|---|---|---|
| 6,763,891 | B2 * | 7/2004 | Humphrey et al. | 166/368 |
| 7,159,669 | B2 * | 1/2007 | Bourgoyne et al. | 166/382 |
| 7,395,866 | B2 * | 7/2008 | Milberger et al. | 166/345 |
| 2003/0089501 | A1 * | 5/2003 | Hartmann | 166/348 |
| 2004/0079527 | A1 * | 4/2004 | Meister et al. | 166/264 |
| 2004/0159439 | A1 * | 8/2004 | Fenton et al. | 166/348 |
| 2004/0251036 | A1 * | 12/2004 | Hopper et al. | 166/384 |
| 2005/0284640 | A1 * | 12/2005 | Borak, Jr. | 166/369 |
| 2008/0029268 | A1 * | 2/2008 | Macfarlane | 166/311 |

FOREIGN PATENT DOCUMENTS

| | | | |
|---|---|---|---|
| WO | WO 2005/116393 | A | 12/2005 |

OTHER PUBLICATIONS

Notification of Transmittal of the International Search Report and the Written Opinion of the International Searching Authority, Or the Declaration, Nov. 22, 2007, pp. 1-2, PCT/US2007/072848, European Patent Office.

International Search Report, Nov. 22, 2007, pp. 1-5, PCT/US2007/072848, European Patent Office.

Written Opinion of the International Searching Authority, Nov. 22, 2007, pp. 1-6, PCT/US2007/072848, European Patent Office.

* cited by examiner

FLOW DIVERTER TOOL ASSEMBLY AND METHODS OF USING SAME

BACKGROUND

1. Field of Invention

The invention is directed to a flow diverter tool assembly, and, in particular, to a flow diverter tool assembly used to clean debris out of a portion of a production tree on an oil or gas well.

2. Description of Art

Subsea production trees with tubing hangers landed therein, referred to as "horizontal" or "spool" trees, are known in the art. Installation of production trees and completion of oil and gas wells prior to running the tubing routinely result in debris collecting in the bore of the production tree in the area where the tubing hanger lands and seals. Debris can also be collected within the bore of the production tree as a result of the production of oil or gas from the well formation. The collection of debris when the tubing hanger is removed or prior to installation may have an adverse impact on sealing the tubing hanger to the bore of the production tree and may clog ports intersecting the bore. Accordingly, it is desirable in the art to provide a tool capable of being placed within the bore of a horizontal production tree to flush out, or clean out, at least some of the debris contained within the bore of the production tree.

Prior devices and methods of cleaning, or flushing, the bore of a production tree include using a jetting sub lowered into the bore. Fluid is pumped through the jetting sub indiscriminately flushing the bore. One drawback to this prior attempt is that it is incapable of accurately directing the flow of fluid through the jetting sub into the ports of the tree. Therefore, it is desired in the art to provide a flow diverter tool assembly and method of flushing a bore of a subsea production tree that can provide directed flow of fluid from the tool to more accurately target debris for removal from the bore and which assures flow through the intersecting ports of the tree.

SUMMARY OF INVENTION

In one aspect, the invention is directed to a flow diverter tool assembly that is placed within a horizontal production tree of an oil and gas well and used to clean debris out of a portion of the production tree including the lower and upper tubing annulus ports found in the production tree. Broadly, the tool includes a housing having a passageway therethrough. The passageway is used to pump fluid down the string, through the tool, and into the bore of the production tree. The passageway is in fluid communication with at least one outlet disposed along the length of the tool, one of which is preferably aligned with the lower tubing annulus port of the production tree so as to facilitate transporting debris within the portion of the production tree into the lower tubing annulus port.

A seal is disposed along the tool such that the bore of the production tree is divided into an upper portion and a lower portion. The seal is disposed within the bore of the production tree such that it rests below the upper tubing annulus port and above the lower tubing annulus port. Therefore, fluid and debris within the lower portion of the bore of the production tree can flow into the upper portion only by flowing into the lower tubing annulus port and out of the upper tubing annulus port.

To facilitate placement of the seal of the tool in the appropriate location, the tool also preferably includes a locator having a flange that is capable of being landed or placed on a shoulder disposed in the bore of the production tree or the wellhead housing below the tree. The length of the locator is determined by the locations of the shoulder, the lower tubing annulus port, and the upper tubing annulus port so that the seal is disposed between the lower tubing annulus port and the upper tubing annulus port.

The flow diverter tool assembly also includes a bypass device located above the seal that allows displaced fluid to flow through the tool, bypassing the seal, when the tool is being retrieved. The bypass device preferably comprises a slip-joint, which includes an inner barrel and an outer barrel. The inner barrel includes an inner port, and the outer barrel includes an outer port. When extended, i.e., when the inner barrel telescopes outward relative to the outer barrel, the inner port and the outer port become aligned with each another. Upon alignment of the inner port with the outer port, the upper portion of the bore of the production tree is placed in fluid communication with the passageway of the flow diverter tool assembly. Lifting the running string to pull the tool from the tree bore causes the inner barrel to slide upward relative to the outer barrel. As a result, a fluid path through the tool is created that bypasses the seal. Therefore, the seal does not have to bear the weight of the column of fluid in the riser as the tool is being retrieved, because the displaced fluid flows through the tool and out of the tool below the seal.

The inner barrel can be connected to the running string so that when running the flow diverter tool assembly into the bore of the production tree, the inner port and outer port are out of alignment. In that instance when running-in, displaced fluid would flow around the sides of the seal.

Alternatively, the inner barrel can be connected to the string from the surface such that when running the flow diverter tool assembly into the bore of the production tree, the inner port and outer port are in alignment. As a result, displaced fluid below the seal may be permitted to flow upward through the tool to facilitate lowering the tool assembly into the bore of the production tree.

During the flushing and removal of debris from the portion of the bore of the production tree, the inner port and outer port of the bypass device should be out of alignment so that all of the fluid flowing through the tool assembly is injected from the tool assembly below the seal. When the flow diverter tool assembly has completed its task of removing debris from the portion of the bore of the production tree, the pumping of fluid down the passageway of the flow diverter tool assembly is stopped. The string is then lifted, causing the inner barrel to slide out of the outer barrel until the inner port is aligned with the outer port. Upon alignment of the inner port with the outer port, fluid above the seal is permitted to flow through the tool into the lower portion below the seal, thereby permitting the flow diverter tool to be removed from the production tree. Alternatively, after aligning the inner port with the outer port, the inner barrel can be slid downward again and the portion of the production tree can be further flushed to remove additional debris.

In another specific embodiment, the passageway of the flow diverter tool assembly includes at least one additional outlet, the production port flushing outlet, which aligns with the production port on the production tree. Therefore, this additional outlet can be used to flush debris from the production port into a flowline or a cross-over line attached to the production port.

In operation, the flow diverter tool assembly is disposed in the bore of the production tree such that the seal of the tool divides the bore of the production tree into at least two portions, an upper portion above the seal and a lower portion below the seal. After installation, fluid is pumped down the passageway and out of the outlets disposed along the housing of the tool. Debris is flushed into the fluid in the lower portion and ultimately forced into the lower tubing annulus port, out of the upper tubing annulus port, and into the upper portion of the bore, where it is permitted to flow out of the well, such as through the riser.

Figure 1:
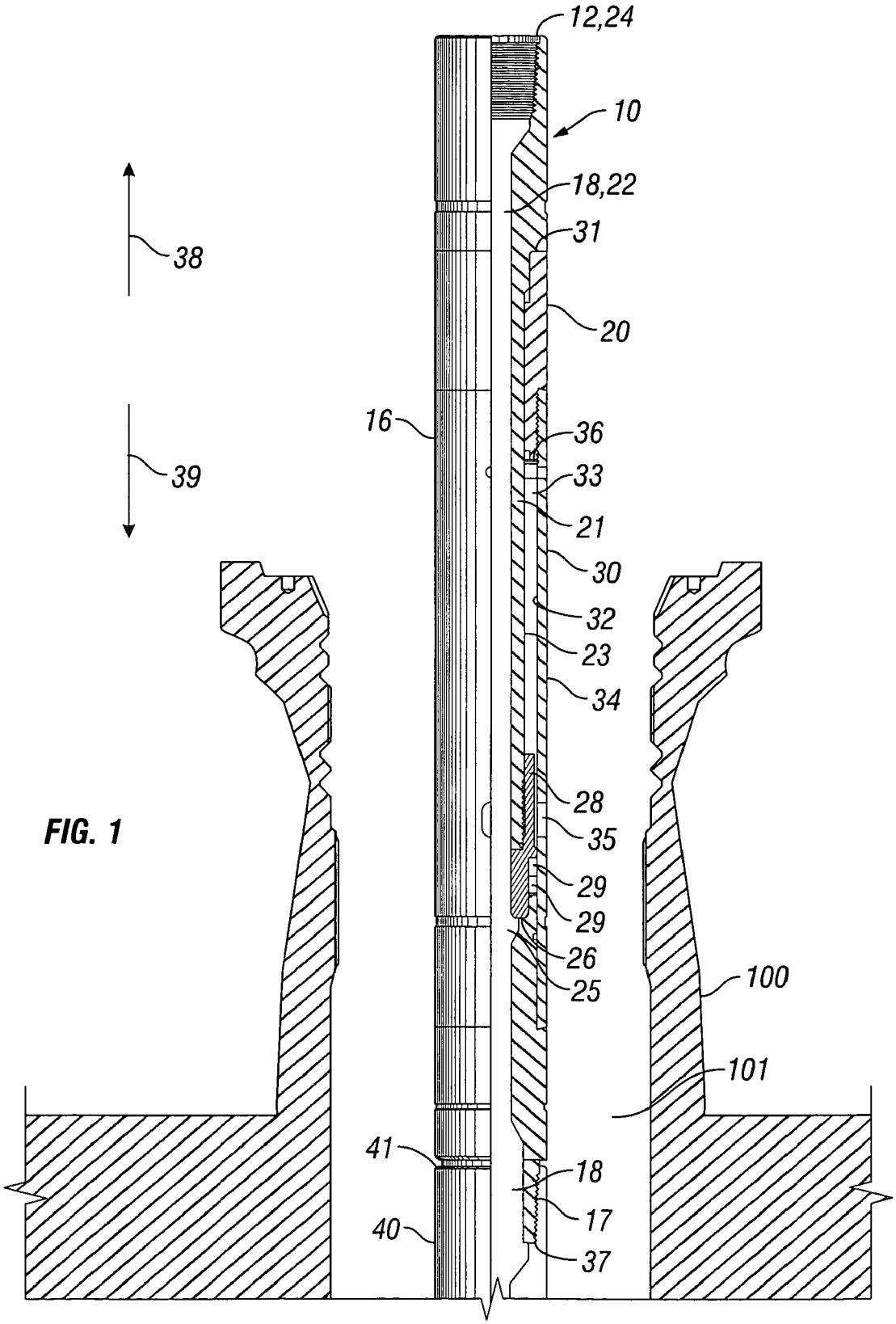
FIG. 1 is a partial cross-sectional view of the upper portion of one embodiment of the flow diverter tool assembly of the present invention together with a partial cross-sectional view of a production tree.

While the invention will be described in connection with the preferred embodiments, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION OF INVENTION

Referring now to FIGS. 1-5, flow diverter tool assembly 10 is disposed in production tree 100. Production tree 100 is a horizontal or spool type production tree having a single bore 101, upper tubing annulus port 102, lower tubing annulus port 104, production passage 106, and landing shoulder 108 for a tubing hanger (not shown). Each tubing annulus port 102, 104 has a valve (not shown) and they are joined together so that fluid can flow into lower tubing annulus port 104 from the annulus surrounding a string of tubing (not shown) installed in bore 101 and back into bore 101 through upper tubing annulus port 102 which is above the string of tubing. Bore 101 includes inner wall surface 109. Production passage 106 may be connected to additional equipment of the tree, such as a choke and sensors for monitoring flow. Also, typically a cross-over line and valve arrangement (not shown) may exist that selectively allows flow from production passage 106 to the junction of the tubing annulus ports 102, 104 and vice-versa.

Flow diverter tool assembly is disposed in bore 101 of production tree 100 in relation to upper tubing annulus port 102, lower tubing annulus port 104, and production passage 106. Production tree 100 lands on and is connected to a wellhead housing 116 that supports one or more strings of casing 118, 120. Production casing 118 is supported by a casing hanger 119 (FIG. 3) that lands in wellhead housing 116. Production tree 100 has an orientation sub 117 on its lower end. Orientation sub 117 has a helical slot for orientating a tubing hanger (not shown) outlet with production passage 106 when the tubing hanger lands.

While production tree 100 is only partially shown in FIGS. 1-5, and only certain components of production tree 100 are described herein, persons of ordinary skill in the art will recognize that flow diverter tool assembly 10 may be used to flush debris from any horizontal production tree or spool member, known or contemplated by persons of ordinary skill in the art, whether or not the spool member has a lateral production outlet, and the term "production tree" is meant to include any tubular subsea wellhead member for supporting a tubing hanger and having a tubing annulus bypass around the tubing hanger, such as upper tubing annulus port 102 and lower tubing annulus port 104.

Broadly, flow diverter tool assembly 10 comprises first end 12, second end 14, housing 16 having fluid passageway 18 longitudinally disposed within housing 16 between first end 12 and second end 14, a fluid by-pass assembly, such as slip-joint portion 20, sealing portion 40, and flushing portion 50 having at least one outlet 53. Flow diverter tool assembly 10 preferably also includes locator portion 60. Although slip-joint portion 20 is shown connected to sealing portion 40 by threads 17, sealing portion 40 is shown connected to flushing portion 50 by threads 17, and flushing portion 50 is shown connected to locator portion 60 by threads 17, it is to be understood that flow diverter tool assembly 10 is not required to be formed by four separate pieces. Nor are the different portions required to be connected by threads 17.

Slip-joint portion 20 includes inner barrel 21 having central passageway 22, exterior surface 23, string connector end 24, inner port 25, and slide end 26. Exterior surface 23 includes flange 28 having one or more seals 29 at slide end 26.

Slip-joint portion 20 also includes outer barrel 30 having slide end 31, inner wall surface 32 forming slide chamber 33 and restrictor 36, exterior surface 34, and outer port 35. Flange 28 of inner barrel 21 is slidably engaged with inner wall surface 32 within slide chamber 33. Restrictor 36 limits the distance inner barrel 21 is permitted to slide or telescope within outer barrel 30.

Inner barrel 21 is slidably engaged within outer barrel 30, thereby permitting inner port 25 and outer port 35 to be placed in, and removed from, alignment with each other by movement of inner barrel 21 within outer barrel 30 in the direction of arrows 38 and 39.

Figure 2:
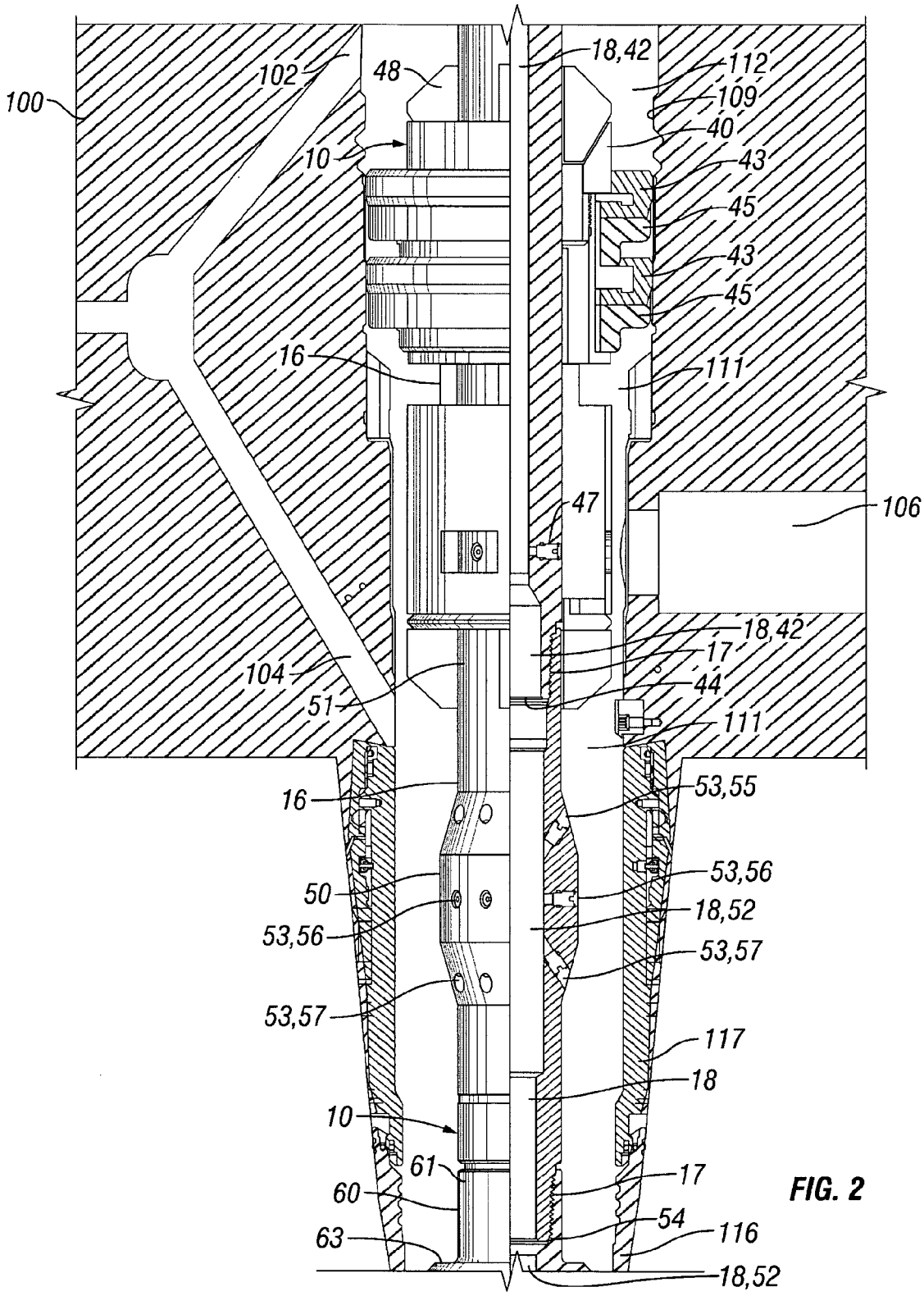
FIG. 2 is a partial cross-sectional view of the middle portion of the embodiment of the flow diverter tool assembly shown in FIG. 1 together with a partial cross-sectional view of a production tree.

Lower end 37 of outer barrel 30 is releasably connected to upper end 41 of sealing portion 40 such as by threads 17. Sealing portion 40 includes central passageway 42, seals 43, and lower end 44. Seals 43 are annularly disposed around the exterior surface of sealing portion 40 such as resting on metal support guide 45. Although seals 43 may be of any type known in the art, seals 43 are preferably neoprene cups with upward facing lips. While two seals 43 are shown in FIG. 2, it is to be understood that any number of seals 43 may be included as part of flow diverter tool assembly 10. Seals 43 are disposed in bore 101 between upper tubing annulus 102 and lower tubing annulus port 104 and divide bore 101 of production tree 100 into two portions, lower portion 111 and upper portion 112.

Sealing portion 40 preferably includes production passage flushing outlet 47 aligned with the production passage 106 of the production tree 100 once installed. Preferably, tool assembly 10 has a guide member (not shown) that engages orientation sub 117 to align production passage flushing outlet 47 with production passage 106 when tool assembly 10 lands. Therefore, any debris collected in the production passage 106 can be flushed by fluid flowing through passageway 18 and out of production passage flushing outlet 47. If desired, by using the cross-over arrangement (not shown) the fluid flowing out production passage 106 can be directed through upper tubing annulus port 102 back into bore upper portion 101

Sealing portion 40 may also include junk basket 48 (FIG. 2) on its upper end for assisting with the removal of debris from bore 101 of production tree 100. Junk basket 48, however, does not permit fluid to bypass seals 43 as traditional junk baskets may permit, such as where seals 43 are replaced by brushes (not shown).

Lower end 44 of sealing portion 40 is releasably connected to upper end 51 of flushing portion 50 such as by threads 17. Flushing portion includes central passageway 52, outlets 53, and lower end 54. Outlets 53 are preferably disposed at three different levels, such as upper outlets 55, middle outlets 56, and lower outlets 57. At least one upper outlet 55 is preferably generally aligned with lower tubing annulus port 104 to facilitate transporting fluid, and debris, into lower tubing annulus port 104 so that it can be carried out upper tubing annulus port 102. For example, upper outlet 55 may be disposed relative to central passageway 52 at an upward angle that is generally the same angle as lower tubing annulus port 104 to facilitate alignment of upper outlet 55 with lower tubing annulus port 104. Preferably, each upper outlet 55 is disposed at an upward inclination relative to central passageway 52, each lower outlet 57 is disposed at a downward inclination relative to central passageway 52, and each middle outlet 56 is disposed perpendicular relative to central passageway 52 to facilitate circulation of fluid, and thus, debris, within lower portion 111 of bore 101 and into lower tubing annulus port 104, out of upper tubing annulus port 102 and into upper portion 112 of bore 101. In one specific embodiment, the upward inclination of each upper outlet 55 is 32 degrees and the downward inclination of each lower outlet 57 is 32 degrees.

Figure 3:
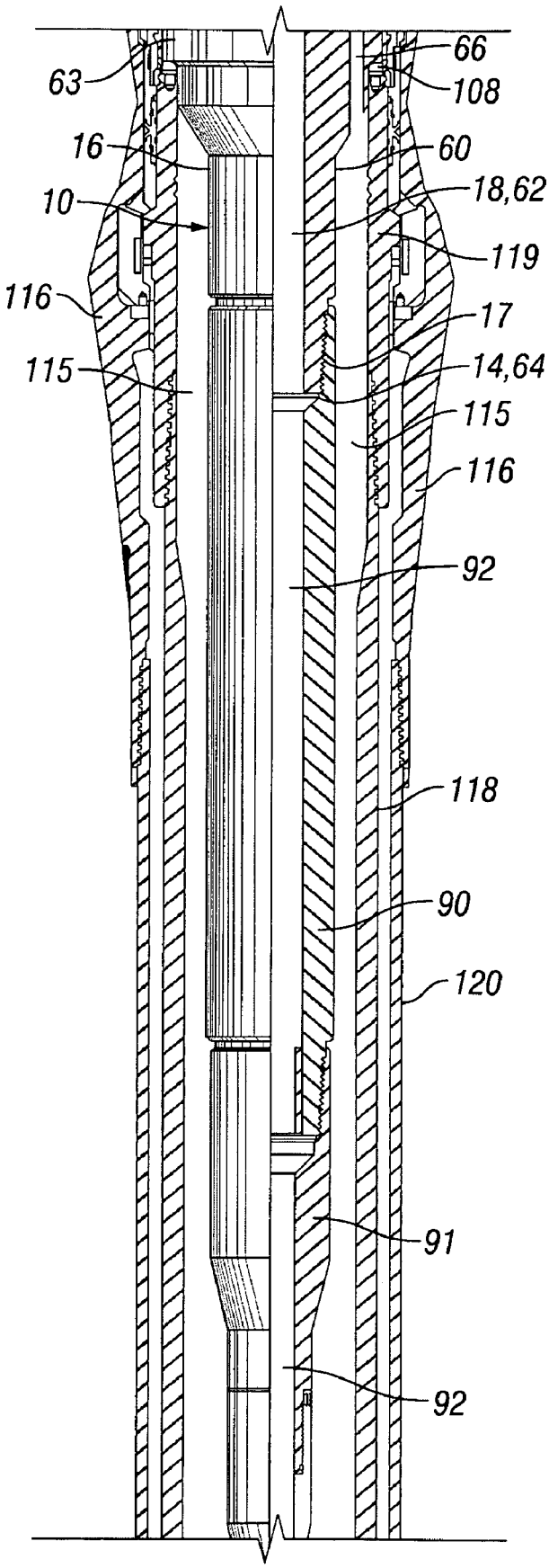
FIG. 3 is a partial cross-sectional view of the lower portion of the embodiment of the flow diverter tool assembly shown in FIGS. 1-2 together with a partial cross-sectional view of a production tree and a partial cross-sectional view of a drill pipe sub attached to the lower end of the flow diverter tool assembly and a partial cross-sectional view of a junk basket attached to the lower end of the drill pipe.
Figure 4:
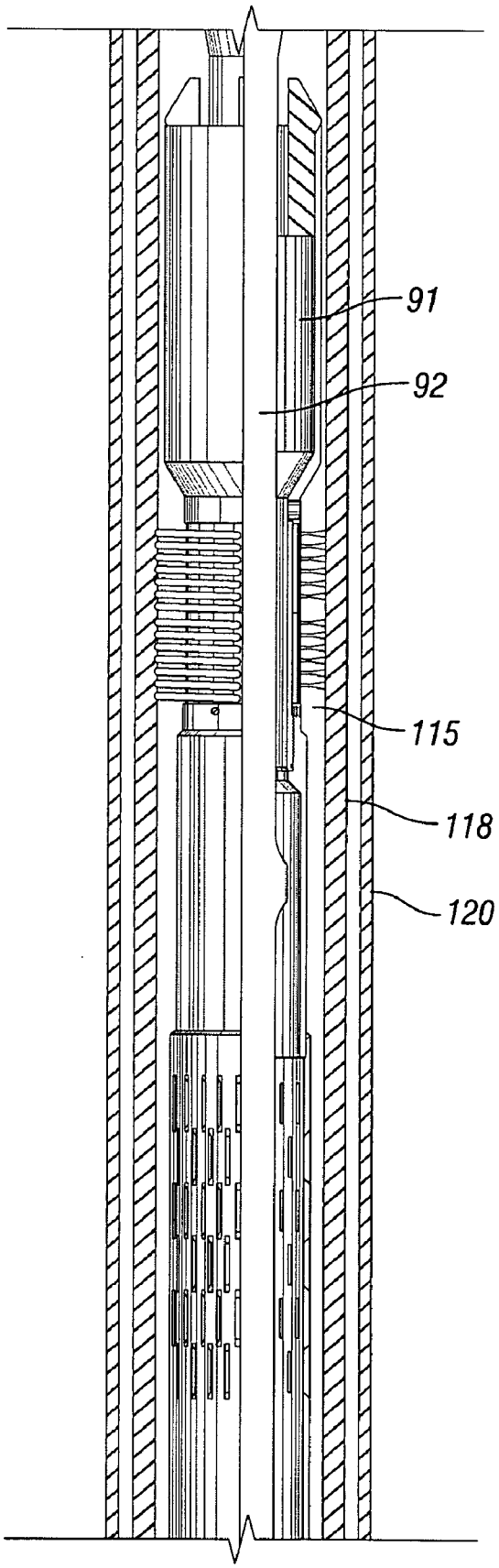
FIG. 4 is a partial cross-sectional view of the junk basket shown in FIG. 3.

Lower end 54 of flushing portion 50 is releasably connected to upper end 61 of locator 60 (FIG. 2) such as by threads 17. Locator 60 includes central passageway 62, landing flange 63, and lower end 64. Landing flange 63 has a diameter that is slightly smaller than the diameter of bore 101 of production tree 100. As shown in FIG. 3, landing flange 63 rests, or lands, on the upper end of casing hanger 119 in wellhead housing 116. Accordingly, flow diverter tool assembly 10 can be accurately placed within bore 101 of production tree 100 so that outlets 53, and preferably production passage flushing outlet 47, are properly aligned to facilitate flushing debris from bore 101 and production passage 106 as described herein. In one specific embodiment, landing flange 62 may include one or more additional passageways 66 to facilitate the movement of fluid from the volume of space below landing flange 62 (i.e., volume of space 115) to the volume of space above landing flange 62 (i.e., lower portion 111), and vice versa.

Figure 5:
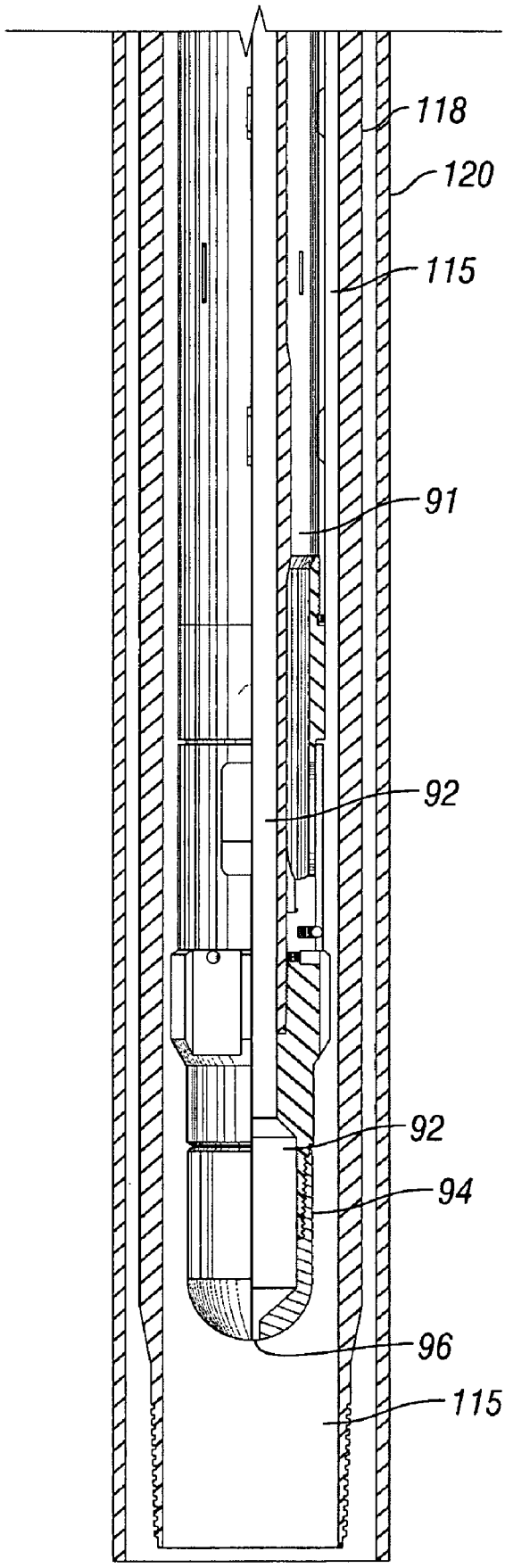
FIG. 5 is a partial cross-sectional view of the junk basket shown in FIGS. 2-3 and a partial cross-sectional view of a ported bull nose attached to the lower end of the junk basket.

Lower end 64 of locator 63 comprises second end 14 of flow diverter tool assembly 10. Lower end 64, or second end 14, may be attached to additional components known to persons skilled in the art, e.g., drill pipe sub 90 (FIG. 3), junk basket 91 (FIGS. 3-5), and ported bull nose 94 having outlet 96 (FIG. 5). Because these components are known to persons of ordinary skill in the art, no further detailed description of these components is necessary. In the embodiment shown in FIGS. 1-5 having drill pipe sub 90, junk basket 91, and ported bull nose 94, fluid is flowed through passageway 18 of flow diverter tool assembly 10, into and through central passageway 92 of drill pipe sub 90, junk basket 91, and ported bull nose 94 (FIG. 5), and out of port 96 to further facilitate cleaning or flushing debris from production tree 100 as well as from casing 118. The fluid flows out of port 96 and into interior 115 of casing 118. The fluid then flows upwards toward locator 60 (FIG. 3), through passageway 66, and into lower portion 111 where it is removed from lower portion 111 in the same manner as discussed above.

Alternatively, end 64, or second end 14, may be attached to a cap (not shown) that prevents fluid from flowing out of passageway 18 except through outlets 53 and, preferably, production passage flushing outlet 47. In this other embodiment, locator 60 preferably does not include any passageways 66.

In operation, flow diverter tool assembly 10 is secured to a string of conduit such as drill pipe and lowered into bore 101 of production tree 100 such that seals 43 are disposed below upper tubing annulus port 102 and above lower tubing annulus port 104. As tool assembly 10 is lowered through the riser, slip-joint portion 20 may be in an extended position such that inner port 25 and outer port 35 are aligned, allowing some fluid to flow through outlets 53, up passageway 18, and through inner port 25 and outer port 35. In this specific embodiment, once tool assembly 10 lands, the weight of the running string causes slip-joint portion 40 to move back to the retracted position in which inner port 25 is not aligned with outer port 35. Seals 43 contact inner wall surface 109 of bore 101 to sealingly divide bore 101 into lower portion 111 and upper portion 112. Slip joint portion 40, if not already in its retracted position, is moved to its retracted position after seals 43 contact inner wall surface 109.

While inner port 25 and outer port 35 of slip-joint portion 40 are out of alignment, fluid is pumped down passageway 18 and, thus, down central passageways 22, 42, 52, and 62. Fluid flows through outlets 53 and production passage flushing outlet 47 to force debris within lower portion 111 and production passage 106, respectively, out of lower portion 111 and production passage 106, into lower tubing annulus port 104, out of upper tubing annulus port 102 and into upper portion 112 of bore 101. Some of the debris conveyed into upper portion 112 will settle into junk basket 48, and some of the debris in upper portion 112 may be carried upward from tree 100 into the riser (not shown).

After a sufficient amount of time has elapsed to remove debris from lower portion 111 of bore 101, the pumping of fluid down passageway 18 is stopped. Flow diverter tool assembly 10 is lifted, causing inner barrel 21 to slide upwardly within outer barrel 30 in the direction of arrow 38. As result of inner barrel 21 sliding upwardly within outer barrel 30, inner port 25 becomes aligned with outer port 35. The alignment of inner port 25 with outer port 35 permits fluid in upper portion 112 of bore 101 to flow into passageway 18 and out of outlets 53 and production passage flushing outlet 47 while tool assembly 10 is pulled upward (arrow 39). As a result, the fluid in the riser bypasses seals 43 while tool assembly 10 moves upwards. Therefore, seals 43 do not have to lift the entire column of fluid in the riser. As tool assembly 10 is pulled upward debris will collect on top of seals 43 and in junk basket 48. This movement of fluid also results in the pressure within bore 101 above seals 43, i.e., in upper portion 112, and the pressure within bore 101 below seals 43, i.e., in lower portion 111, to move toward equilibrium as tool 10 is being pulled upward, facilitating removal of flow diverter tool assembly 10 from bore 101.

In one specific embodiment, flow diverter tool assembly 10 is not removed after a first cleaning of debris from bore 101, but instead, inner barrel 21 is slid back into outer barrel 30 causing inner port 25 to no longer be aligned with outer port 35. Thereafter, fluid is again pumped down passageway 18 and, thus, central passageways 22, 42, 52, and 62, and out of outlets 53 and production passage flushing outlet 47 to remove additional debris from lower portion 111 of bore 101. These steps can be repeated as many times as desired or necessary to sufficiently remove as much debris as possible or desired from lower portion 111 of bore 101.

After removal, the well is completed conventionally. A tubing hanger (not shown) is connected to a string of tubing and lowered into the well. The tubing hanger lands on shoulder 108 in bore 101 and has a production outlet that aligns with production passage 106 with the assistance of orientation sub 117. Circulation between the tubing annulus surrounding the tubing and the interior of the tubing is achieved via upper tubing annulus port 102 and lower tubing annulus port 104 in a conventional manner.

In one specific embodiment, seals 43 can be inflated and deflated such as by placing seals 43 in fluid communication with hydraulic fluid pressure delivered from the surface. Seals 43 could also be inflated or energized from retracted to sealed positions using the pressure of the fluid being pumped down passageway 18 to outlets 53. For example, pressure relief valves (not shown) could be located in outlets 53 to assure that seals 43 inflate or are energized before fluid is allowed to be discharged from outlets 53. If seals 43 are of that type, seals 43 would be recessed when flow diverter tool assembly 10 is placed within bore 101 of production tree 100. After properly locating flow diverter tool 10 within bore 101, seals 43 are inflated or energized. Flow diverter tool assembly 10 is then operated in the same manner as described above. After flow diverter tool assembly 10 removes the debris from bore 101, seals 43 are would be recessed, causing the release of pressure by seals 43 and, thus, release of flow diverter tool assembly 10, from inner walls surface 109 of bore 101, allowing flow diverter tool assembly 10 to be removed from bore 101. The bypass device comprising slip joint 20 might not be required if seals 43 were of a type that inflated or energized.

It is to be understood that the invention is not limited to the exact details of construction, operation, exact materials, or embodiments shown and described, as modifications and equivalents will be apparent to one skilled in the art. For example, as mentioned above, the flow diverter tool assembly is described herein as being formed by four separate portions releasably connected by threads. However, the flow diverter tool assembly may be formed out of one, two, three, five, or any other number of portions as desired or necessary, such as to facilitate fabrication, transportation, and installation within the bore of the production tree. Accordingly, the invention is therefore to be limited only by the scope of the appended claims.

The invention claim is:

1. A subsea wellhead assembly comprising:

a subsea production tree having a bore, an upper tubing annulus port, and a lower tubing annulus port, the upper tubing annulus port and the lower tubing annulus port each intersecting the bore and in communication with each other exterior of the bore; and a retrievable tool for cleaning the bore, the retrievable tool comprising a housing having an upper end for connection to a string of conduit to run the housing into and out of the bore, a passageway longitudinally disposed within the housing, at least one outlet disposed within the housing and in fluid communication with the passageway, and a seal disposed on an exterior surface of the housing above each of the at least one outlets, the seal sealing against the bore of the subsea production tree between where the lower tubing annulus port and the upper tubing annulus port intersect the bore, such that fluid pumped down the string of conduit flows down the passageway, out at least one of the at least one outlets, up the lower tubing annulus port and out the upper tubing annulus port into the bore to clean the bore.

2. The subsea wellhead assembly of claim 1, wherein the retrievable tool further comprises a bypass device that bypasses fluid around the seal while the retrievable tool is being retrieved from the bore.

3. The subsea wellhead assembly of claim 2, wherein the bypass device comprises a slip-joint assembly disposed above the seal and having an inner barrel slidably engaged with an outer barrel for movement between a retracted and an extended position, the inner barrel having an inner port and the outer barrel having an outer port that register with each other to allow flow from the exterior of the slip joint assembly into the passageway while in the extended position.

4. The subsea wellhead assembly of claim 1, wherein the retrievable tool further comprises a landing flange disposed below the seal on the housing for landing the retrievable tool in the subsea production tree.

5. The subsea wellhead assembly of claim 4, wherein the landing flange includes a landing flange passageway that allows fluid communication on the exterior of the landing flange from below to above the landing flange.

6. The subsea wellhead assembly of claim 1, wherein at least one of the at least one outlets is located below where the lower tubing annulus port intersects with the bore.

7. The subsea wellhead assembly of claim 1, at least one of the at least one outlets extends upward and outward from the passageway.

8. The subsea wellhead assembly of claim 1, wherein the subsea production tree has a laterally exterior production passage, and the assembly further comprises at least one production passage flushing outlet disposed on the housing in communication with the passageway in the housing and disposed above each of the at least one outlets, the at least one production passage flushing outlet being oriented toward the production passage in the subsea production tree for cleaning the production passage.

9. The subsea wellhead assembly of claim 1, wherein the seal is an elastomeric member having an upward extending lip seal.

10. A tool assembly for use in cleaning a bore of a subsea production tree having an upper tubing annulus port and a lower tubing annulus port, the subsea production tree being connected to a riser, the tool assembly comprising:

a housing having an upper end for connection to a string of conduit to run the housing into and out of the bore;

a passageway longitudinally disposed within the housing;

an outlet in fluid communication with the passageway;

a seal disposed on an exterior surface of the housing above the outlet for sealing to the bore of the subsea production tree, so that fluid may be pumped down the string of conduit, out the outlet and through the upper tubing annulus port and the lower tubing annulus port into the bore above the seal; and a fluid bypass for the seal that is selectively opened to allow fluid in the riser to flow past the seal as the tool is retrieved from the bore.

11. The tool assembly of claim 10, wherein the fluid bypass comprises a slip-joint assembly disposed above the seal and having an inner barrel slidably engaged with an outer barrel for movement between a retracted and an extended position, the inner barrel having an inner port and the outer barrel having an outer port that register with each other to allow flow from the exterior of the slip joint assembly into the passageway while in the extended position.

12. The tool assembly of claim 10, wherein the retrievable tool further comprises a landing flange disposed below the seal on the housing for landing the retrievable tool in the subsea production tree.

13. The tool assembly of claim 12, wherein the landing flange includes a landing flange passageway that allows fluid communication on the exterior of landing flange from below to above the landing flange.

14. The tool assembly of claim 10, the outlet extends upward and outward from the passageway.

15. The tool assembly of claim 10, wherein the subsea production tree has a laterally exterior production passage, and the assembly further comprises at least one production passage flushing outlet disposed on the housing in communication with the passageway in the housing and disposed above each of the at least one outlets, the at least one production passage flushing outlet being oriented toward the production passage in the subsea production tree for cleaning the production passage.

16. The tool assembly of claim 10, wherein the seal is an elastomeric member having an upward extending lip seal.

17. A method of flushing a portion of a bore of a subsea production tree having a bore, an upper tubing annulus port, and a lower tubing annulus port, the upper tubing annulus port and the lower tubing annulus port each intersecting the bore and in communication with each other exterior of the bore, the method comprising the steps of:

(a) providing a tool assembly comprising
a housing having a passageway,
a seal disposed on an exterior surface of the housing, and
an outlet in fluid communication with the passageway disposed below the seal;

(b) lowering the tool assembly into the bore of the subsea production tree such that the seal sealingly engages an inner wall surface of the bore between where the lower tubing annulus port and the upper tubing annulus port intersect the bore; and (c) pumping a fluid down the passageway and out of the outlet to cause debris to flow from the bore, into the lower tubing annulus port, out of the upper tubing annulus port, and into the bore above the seal.

18. The method of claim 17, further comprising:

(d) ceasing the pumping of the fluid down the passageway after step (c); and (e) lifting the tool assembly from the bore and directing fluid in the bore above the seal into the passageway and out of the outlet to bypass the seal as the tool assembly is retrieved from the bore.

19. The method of claim 17, wherein the subsea production tree has a laterally extending production passage leading from the bore to an exterior portion of the tree;

step (b) comprises sealing the seal to an inner wall surface of the bore above the production passage.

20. The method of claim 17, wherein step (a) comprises providing a production passage flushing outlet in the housing in fluid communication with the passageway;

step (b) comprises rotating the tool assembly as it lands to orient the production passage flushing outlet toward the production passage in the subsea production tree; and step (c) comprises pumping a portion of the fluid out of the production passage flushing outlet into the production passage.

* * * * *